United States Patent [19]

Winckler et al.

[11] Patent Number: 4,583,995

[45] **Date of Patent: * Apr. 22, 1986**

[54] METHOD OF PRODUCING SYNTHESIS GAS

[75] Inventors: Lothar Winckler, Gladbeck; Klaus Fuhrmann, Dorsten; Ulrich Graeser, Haltern; Peter Wenning, Dorsten, all of Fed. Rep. of Germany

[73] Assignee: Veba Oel Entwicklungs-Gesellschaft mbH., Gelsenkirchen, Fed. Rep. of Germany

[ * ] Notice: The portion of the term of this patent subsequent to Apr. 22, 2003 has been disclaimed.

[21] Appl. No.: 660,972

[22] Filed: Oct. 15, 1984

[30] Foreign Application Priority Data

Oct. 15, 1983 [DE] Fed. Rep. of Germany ..... 3337621

[51] Int. Cl.[4] ..... C10J 3/06

[52] U.S. Cl. ..... 48/197 R; 48/210; 201/35; 252/373

[58] Field of Search ..... 201/32, 33, 35, 25, 201/44, 41; 202/118, 270; 48/86 R, 197 R, 210, 77; 252/373; 208/126, 177, 8 R, 11 R, 10

[56] References Cited

U.S. PATENT DOCUMENTS

| | | | |
|---|---|---|---|
| 1,428,458 | 9/1922 | Thompson | 202/118 |
| 1,817,926 | 8/1931 | McIntire | 201/33 |
| 3,075,912 | 1/1963 | Du Bois Eastivan et al. | 208/107 |
| 3,691,019 | 9/1972 | Brimhall | 202/118 |
| 3,787,292 | 1/1974 | Keoppler | 202/118 |
| 3,976,548 | 8/1976 | Kevorkian et al. | 201/32 |
| 4,077,868 | 3/1978 | Chambers | 208/11 R |

*Primary Examiner*—Peter Kratz

*Attorney, Agent, or Firm*—Oblon, Fisher, Spivak, McClelland & Maier

[57] ABSTRACT

A method of producing synthesis gas from coal hydrogenation residues, wherein a coal hydrogenation residue is subjected to a reduced pressure distillation in a one-shaft or multishaft worm apparatus where the gases and vapors evolved are withdrawn and the unvolatilized remaining material is re-pressurized and is then introduced into a gasification reaction.

3 Claims, 1 Drawing Figure

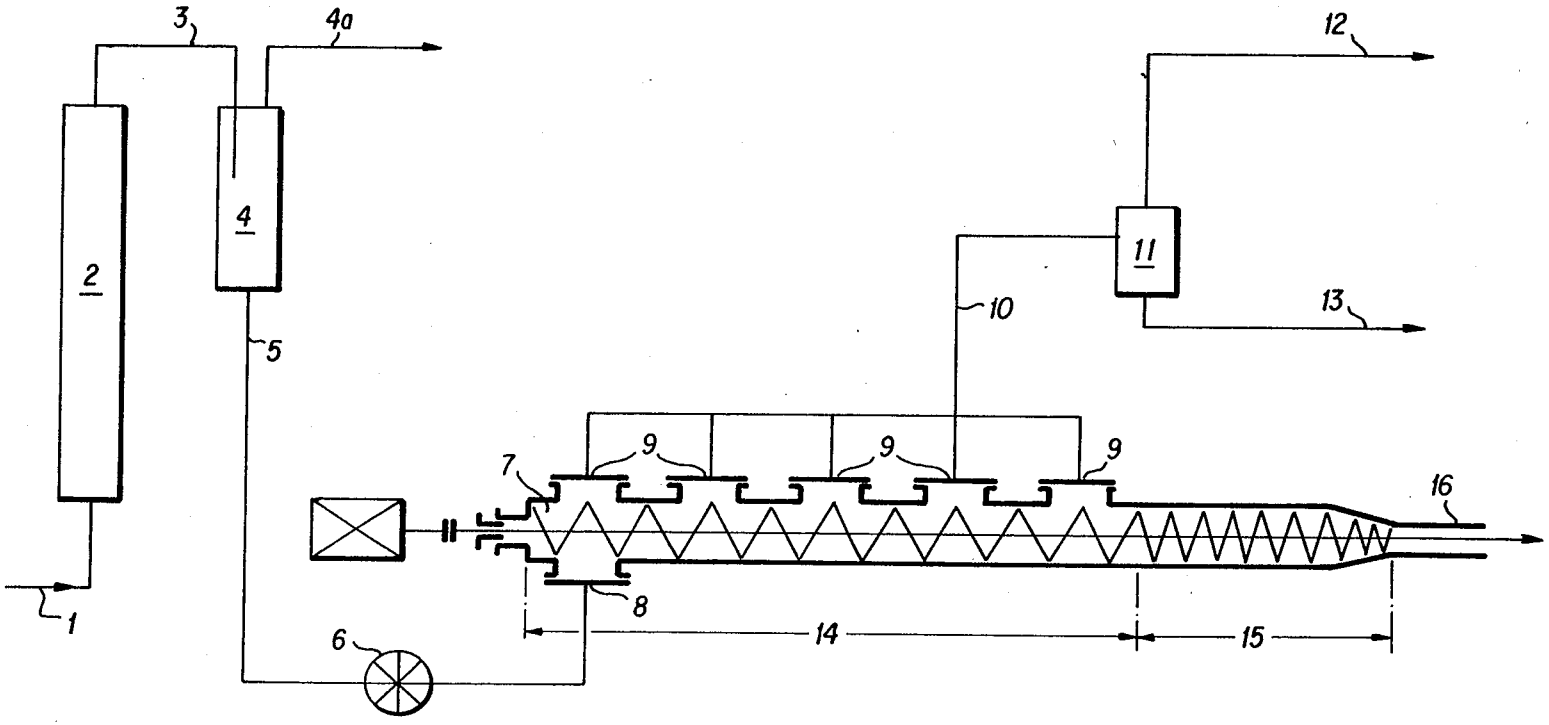
1
2
3
4
4a
5
6
7
8
9
9
9
10
11
12
13
14
15
16

METHOD OF PRODUCING SYNTHESIS GAS

BACKGROUND OF THE INVENTION

1. Field of the Invention

The invention pertains to the field of synthesis gas production and recovery of hydrogen gas therefrom, especially wherein said synthesis gas is obtained from coal hydrogenation residues.

2. Background of the Invention

A method is disclosed in U.S. Pat. No. 3,075,912 according to which, residues from coal hydrogenation which are separated from the gaseous and liquid products of the hydrogenation in hot separator units, wherein phase separation occurs at the pressure and temperature of the reaction or at a slightly lower temperature, are used to produce synthesis gas from which hydrogen is recovered, e.g. to be used in the original hydrogenation process. In addition to solids (such as unreacted coal, ash, and catalysts) and non-volatile liquids or viscous intermediate products (such as asphaltenes and pre-asphaltenes), the hydrogenation residues contain valuable volatile product oils which must be separated out before the gasification in order to improve the yield of liquid product.

Various methods, such as filtration, centrifugation, vacuum distillation, etc. are known for removing these volatile oil components. The oils recovered may then be used as slurry oils or components of slurry oils for the coal material being hydrogenated. Some of the oil separated by filtration or centrifugation contains a substantial fraction of impurities in the form of non-volatile, difficultly hydrogenatable, oil-soluble intermediate products, e.g. asphaltenes and pre-asphaltenes, which are detrimental to the hydrogenation process and for which much more severe hydrogenation conditions are required in order to break them down.

The above difficulties may be overcome by employing vacuum distillation. The oils recovered by vacuum distillation of the hydrogenation residue are valuable as slurry oils, or may be further hydrogenated under relatively mild conditions. However, the vacuum distillation residues present major handling problems. In particular, such residues are very difficult to remove from the vacuum distillation column and to transfer to the gasification apparatus as well as to charge into the latter, because of the high viscosity of the materials which have a high proportion of solids.

SUMMARY OF THE INVENTION

The object of the present invention is to overcome these difficulties. This is achieved according to the invention by subjecting the coal hydrogenation residue (which is to be understood as a residue from the process of U.S. Pat. No. 3,075,912 or from other processes; see Frank, H. G. and A. Knop, 1979, "Coal refining", Springer Verlag, Berlin, Heidelberg, New York, 1979, pp. 228–51) to a reduced pressure distillation in a one-shaft or multishaft screw extruder, wherein the voltage fraction is withdrawn and the remaining material is then pressurized in the screw extruder and is then fed directly to the gasification reactor. The hydrogenation residue, the viscosity of which continuously increases during the distillation, is continuously worked by the screw[s] as it is conveyed by said screw through the distillation zone of the screw extruder, whereby the volatile components of said residue are withdrawn.

One-shaft or multishaft screw extruders with gas or steam withdrawal are known, e.g. fron U.S. Pat. Nos. 1,156,096 and 2,615,199. They are particularly used in plastics manufacturing where they serve, among other things, as apparatuses to remove gases and monomers from polymerization mixtures (see M. Herrmann, 1972, "Screw extruders in process engineering", Springer Verlag, Berlin, Heidelberg, New York). Although the difficulties associated with oil separation have been known since the first coal hydrogenation on an industrial scale, for a long time vacuum screw extruders were not used for processing coal hydrogenation residues. The processing of hydrogenation residues involves different objectives from a process standpoint from the manufacturing of plastics. In the plastics industry the screw extruders comprises a part of the polymerization reactor, wherein the removal of the monomers in the vaccum zone is accompanied by interruption of the polymerization reaction, whereas in the case of coal hydrogenation a second objective is to concentrate the solids in the hydrogenation residue.

The recommended pressures for use in distilling the hydrogenation residue in the one-shaft or multishaft screw extruder are 0.01 to 0.6 bar, preferably 0.02 to 0.1 bar. According to a refinement of the invention, the pressure decreases over the length of the screw extruder beginning at the entry of the slurrylike hydrogenation residue and extending through an evaporation zone of said apparatus, said pressure range being as mentioned supra, with the pressure decreasing from the upper end to the lower end of said pressure range (0.6 to 0.01 bar, preferably 0.1 to 0.02 bar). This technique reduces the hazard of irregularities in the distillation process in the screw extruder.

The temperature at which the distillation of hydrogenation residues is carried out in worm apparatuses is recommended to be in the range 200° to 400° C., preferably 250° to 350° C. According to a refinement of the invention, the temperature increases over the length of the screw extruder beginning at the entry of the hydrogenation residue and extending through an evaporation zone of said apparatus, said temperature range being as mentioned supra, with the temperature increasing from the lower end to the upper end of said range (200° to 400° C., preferably 250° to 350° C.), under conditions of constant or decreasing pressure over the length of the screw extruder. In this way the time for the hydrogenation residues to reach high temperatures which favor the undesired transformations is reduced, and further processing of the residue which is now freed of volatile components is facilitated. According to the inventive method, residues can be processed in the distillation separation up to a final viscosity of about 2,000 mPa (at 250° C.).

The gaseous oils withdrawn from the screw extruder may be advantageously employed as slurry oils, or may be combined with the other hydrogenation oils, e.g. the gaseous hydrogenation products exiting the hot separator, and the combination may be subjected to further processing, such as additional hydrogenation.

According to the invention the residual material comprised of non-volatilized material is then pressurized in the screw extruder and charged directly to the gasification reactor. In this connection, the screw extruder advantageously comprises a compression zone near the distillation zone, which compression zone is connected with a system for direct charging into the gasification reactor.

The invention is suitable for processing all hydrogenation residues occurring in high pressure coal hydrogenation processes wherein coal is mashed with comminution oil and is converted at high temperature and pressure with hydrogenation hydrogen, possibly in the presence of a catalyst. The so-called Bergius-Pier process is such a process.

BRIEF DESCRIPTION OF THE DRAWINGS

The FIGURE depicts a preferred apparatus for carrying out the process of the invention. The FIGURE will be further described in detail uder the description of the preferred embodiment, infra.

DESCRIPTION OF THE PREFERRED EMBODIMENT

The invention will be further described with the aid of the following exemplary embodiment and the drawing.

A typical "Gasflamm"-coal from the Ruhr region is comminuted and then mashed with comminution oil recycled from the process. The resulting mixture is then preheated and fed via line 1 along with the hydrogenation hydrogen and with the addition of an iron catalyst, to a hydrogenation reactor 2 at 300 bar and 470° C.

The conversion product leaves reactor 2 via line 3 and is fed to the hot separator 4 wherein the volatile products existing under the prevailing conditions are separated from the solid and liquid conversion products, at process pressure (ca. 300 bar) and 460° C.

These volatile products are withdrawn at the top via line 4a and are further processed in known fashion. After being brought to atmospheric pressure, the solid and liquid reaction products are sent via line 5 into the vacuum evaporator worm apparatus 7 with integrated pressurization zone.

The feed into the liquid space of the evaporator 7 is from the bottom, in order to achieve a seal between the entering stream of hydrogenation products coming from the hot separator and the vacuum evaporation zone. A positive displacement pump system 6 is employed as the delivery means for the feed stream, and serves also as a dosing means.

In the screw extruder 7, furnished with a double screw, a pressure of 0.1 bar (absolute) is established via vacuum line 12. The hydrogenation residue employed, which is fed to the screw extruder 7 via pipes 8, contains 50 wt. % oil boiling at 325° C. and above 15 wt. % high molecular weight components (determined to be asphaltene and pre-asphaltene in the amounts 10 and 5 wt. % of the total, respectively), and 35 wt. % inorganic components (24 wt. % represented by ash and the remaining 11 wt. % by uncoverted coal). Of said ash, 32 wt. % is $SiO_2$, 26 wt. % is $Al_2O_3$, 25 wt. % is $Fe_2O_3$, and 17 wt. % other components, according to analyses which have been carried out.

The separation of the distillate occurs at a pressure of 0.1 bar, with the hydrogenation residue heated from 250° to 350° C. in the screw extruder 7 during the distillation. Eighty weight percent of the distillable components of the oil fraction are volatilized and are drawn off from the evaporation zone 14 via the pipes 9, cooled (not shown), and further drawn away via line 10, condensate container 11, and line 13. The uncondensed fractions are drawn off overhead of condensate container 11 via line 12.

In tests, the softening point of the residue after passing through the evaporation zoner 14 was 180° C. The viscosity of this residue at 250° C. was measured to be 1500 mPas. The composition of the residue was found by analysis to be the following (on a water-free basis): C 66.0 wt. %, S 2.5 wt. %, H 3.6 wt. %, N 1.0 wt. %, O 0.9 wt. %, and ash 26.0 wt. %.

The distillable components withdrawn via line 13 may be recycled to the hydrogenation system, as valuable components of the comminution oil.

The evaporation zone 14 is separated from the feed 16 to the gasification reactor by a compression stage 15 employing known technology with a suitable screw configuration and with the disposition of suitable screw elements in this compression stage region. In this compression stage, the residue is pressurized, which residue is comprised of only 10 wt. % (based on the original residue fed) residual oils, with the rest of this residue comprising inorganic components and higher molecular weight intermediate products. The pressurized residue is then fed to the gasification reactor. In this way the de-volatilized residue is delivered to the gasification reactor against the pressure prevailing in said reactor, under an effective seal with respect to the evaporation zone 14.

The screw extruder is heated in a jacket thereof, with superheated steam.

Alternatively, of equal technical merit, the screw extruder may be heated by electrically heated jaw pieces, or by induction heating, or by flue gas or heat transfer oil flowing in the jacket of the screw extruder.

What is claimed as new and intended to be secured by Letters Patent is:

1. A method of producing synthesis gas from flowable liquid containing coal hydrogenation residues, which comprises:

passing said liquid containing hydrogenation residue by means of a positive displacement pump system into a screw extruder consisting of an evaporation zone followed by a mechanical compression stage, said passing of the residue into the extruder occurring through a liquid space in the bottom of said extruder;

subjecting said liquid containing hydrogenation residue to distillation under conditions in which the pressure decreases from 0.6 bar to 0.01 bar or decreases from 0.1 bar to about 0.02 bar and the temperature increases from 200° C. to 400° C. or increases from 250° C. to 350° C. through the length of the evaporation zone of said extruder, thereby producing gases and vapors and viscous unvolatilized remaining material;

withdrawing said gases and vapors evolved;

repressurizing said unvolatilized remaining material; and introducing said material directly into a gasification reactor as said material is obtained from said mechanical compression stage of said extruder.

2. The method according to claim 1, wherein said pressure decrease is from about 0.1 bar to about 0.02 bar.

3. The method according to claim 1, wherein said temperatures range from about 250° to 350° C.

* * * * *